United States Patent [19]

Nixon

[11] 4,284,668

[45] Aug. 18, 1981

[54] PAINT SEALANT WITH TEFLON T.F.E

[75] Inventor: Charles R. Nixon, Redington Beach, Fla.

[73] Assignee: Tough-Guard, Inc., Pinellas Park, Fla.

[21] Appl. No.: 69,706

[22] Filed: Aug. 27, 1979

[51] Int. Cl.[3] ..... B05D 3/02; B05D 3/12; B05D 1/36; B05D 7/00

[52] U.S. Cl. ..... 427/355; 427/385.5; 427/387; 427/388.1; 427/407.1; 427/409; 427/429; 428/422; 428/447; 428/450

[58] Field of Search ..... 427/355, 388 A, 388 C, 427/388 D, 393, 408, 409, 388.1, 388.2, 388.4, 388.5, 407.1, 387, 429, 385.5; 260/42.27, 29.6 F; 428/422, 447, 450

[56] References Cited

U.S. PATENT DOCUMENTS

| | | | |
|---|---|---|---|
| 2,684,177 | 7/1954 | Kennedy | 427/409 X |
| 3,377,193 | 4/1968 | Stilman | 260/42.27 X |
| 3,463,660 | 8/1969 | Bentley et al. | 427/409 X |
| 3,498,824 | 3/1970 | Chadha | 427/409 X |
| 3,505,099 | 4/1970 | Neuroth | 427/409 X |
| 3,939,114 | 2/1976 | Camelon et al. | 260/42.27 X |
| 3,940,359 | 2/1976 | Chambers | 260/42.27 X |
| 4,015,032 | 3/1977 | Hanna | 427/355 X |
| 4,070,525 | 1/1978 | Vassiliou et al. | 427/409 X |
| 4,151,138 | 4/1979 | Citrone et al. | 427/355 X |

FOREIGN PATENT DOCUMENTS

| | | | |
|---|---|---|---|
| 637362 | 2/1962 | Canada | 260/42.27 |
| 966814 | 8/1964 | United Kingdom | 427/409 |

*Primary Examiner*—Michael R. Lusignan
*Attorney, Agent, or Firm*—William A. Newton

[57] ABSTRACT

Disclosed is a paint sealant and method of applying the same to painted surfaces wherein a T.F.E. Teflon in a dispersion carrier is mixed with a fine abrasive in a dispersion carrier and heat is applied by buffing to burn off the dispersion carriers so as to produce a durable protective coating of Teflon. A second hard coating is applied to cover the Teflon.

6 Claims, No Drawings

PAINT SEALANT WITH TEFLON T.F.E

FIELD OF THE INVENTION

The present invention relates to paint sealants to protect surfaces from corrosive, paint damaging environments.

DESCRIPTION OF THE PRIOR ART

Corrosive environments are extremely harmful and damaging to unprotected painted surfaces, such as those of an automobile or boat. For example, photolysis, the ultraviolet and infrared rays of the sun, moisture-laden salt air, insects and other harmful elements all contribute to the deterioration of painted surfaces. There exists in the prior art numerous products for protecting these painted surfaces, such as Paste Canarba and vegetable waxes, paste petroleum based waxes, liquid combined vegetable and petroleum waxes, an organic composition, or activated silicone polyethylene polymers.

Painted surfaces of vehicles and boats, even though they may appear smooth to the naked eye, will under extreme magnification appear as a field of peaks and valleys. The vegetable and petroleum paste and liquid waxes are designed to fill in these minute peaks and valleys of the painted surfaces to smooth-out the surface, thereby giving the painted surface a polished appearance. At the same time, these waxes attempt to give the painted surfaces limited protection from paint destroying elements. Through dissipation, the vegetable and petroleum compounds are limited in their protecting capabilities. More specifically, these wax compounds have low melting points ranging from as low as 128° F. to 180° F. When the temperature of the painted surface exceeds the melting point of the compound applied thereon, the waxes will melt from a hard wax to an oil. When this occurs, the waxes are easily washed off and, more importantly, will pick up dust particles and other air polutants. In actual practice, the temperature frequently leads to melting of the wax compounds. For example, painted surfaces exposed to ambient temperatures of 80° F. in direct sunlight, will rise up to a temperature of 185° F. or more. Consequently, the extremely fine film of wax covering the peaks of the painted surface is very quickly dissipated, leaving them exposed to the elements to become oxidized. At best, with some types of paints, some protection would be provided if re-waxing occurs every 50 to 75 days. On the other hand, if the paint finishes contain silver or aluminum metallic particles, then the wax coatings would provide little or no protection, since the metallic particles retain more heat and, therefore, rapidly destroy the protection of the waxes.

At the present state of the art, silicone polymers are now used to a much better advantage over the vegetable and petroleum waxes. These protective agents will withstand far greater temperature ranges both in the cold and heat. Moreover, these silicones are much tougher than the waxes when fully cured and they are also easily applied. More specifically, these silicones will give protection from −90° F. to 450° F. when applied by hand rubbing. This hand rubbing creates a molecular crawl of molecules which fills the valleys and covers the peaks of the painted surfaces. Also, fine scratches and imperfections in the painted surfaces are filled so as to give protection against rust and corrosion. Moreover, corrosion inhibitors are added to most of the silicone products commercially available. Silicones will also protect the peaks for a much longer period of time and exposure. The silicone's tougher body will not melt or wash off as would a vegetable or petroleum wax, and will give protection of the hills of the paint for up to 6 months and longer, depending on the number of times the surface has been washed.

However, the use of silicones in the present practice of the art has several inherent disadvantages. Automatic car washers will break down the silicone coating on automobiles quickly, in that the brushes move across the paint and wipe off the silicones from the peaks and drive them down through the porous paint and metal primer coats to the metal. The more car washes the surface goes through, the more the silicones are driven down through the paint. Moreover, the wiped off peaks become exposed first and start to oxidize. This gives the painted surface a dull appearance at first, then discoloration and chalking sets in. If the painted surfaces are exposed long enough, the pigments of the paint will be totally decomposed and destroyed and cannot be brought back to life with any kind of treatment. Hence, the paint would have to be sanded off the surface, and a fresh coat of paint applied.

To overcome the above described art problem with silicones, a number of chemicals were tried by the inventor to prevent the silicones from being driven down through the porous paint surface. For example, varnishes, polymers, lacquers, and clear enamels were all tried. These chemicals all had a similar effect on the paint. More specifically, after a period of time they would eventually crack and/or peel again, leaving the original painted surface exposed to the elements.

The inventor then experimented with a number of fluorocarbons. The fluorocarbons, being inert to almost all elements, seemed to be the ideal chemical to seal the porosity of the paint, while still keeping the paint's flexibility and not having the cracking and peeling effect. The following commercially available fluorocarbons were tested by mixing them with the silicone polyethylene polymers and applying them to the painted surface. Problems of shelf life quickly became evident as the fluorocarbons and silicone polymers were very unstable when mixed together. The fluorocarbons tested, all of which are manufactured by E. I. DuPont de Nemours and Co., Inc. are as follows: (1) DLX 6000 experimental fluorocarbon micropowder, (2) "Teflon" tetrafluoroethylene T.F.E. monomer, (3) fluorentatedethylenepropylene F.E.P. "Teflon", and (4) hexafluoropropylene H.F.P. "Teflon". All four products were tested by adding them to various silicone bases, and each was found to be so unstable that it was impossible to work with them in this form.

Experiments using the four products were then conducted on a two part program. The fluorocarbons were used by themselves and were hand rubbed into the paint. Each experiment produced the same results, such results being (1) dull finish, (2) grease film on surface, (3) water spots would be left and (4) a dirty road film would not wash off with car wash detergents and the surface would have to be washed with a petroleum solvent first.

In later experiments, the inventor tried an entirely new approach. The fluorocarbons were applied with high speed buffing machines, using various size wool pile buffing pads. The polymerized Teflons, normally comprising a powder with particle sizes as high as 35 microns, proved to create the same unsatisfactory results. However, within certain constraints, to be described hereinafter, tetrafluoroethylene produced new and unexpected results that proved to be very satisfactory.

SUMMARY OF THE INVENTION

The present invention is directed toward a paint sealant and method of applying the same to a painted surface. The paint sealant composition comprises a tetrafluoroethylene (T.F.E.) monomer gas in a dispersion carrier and a fine abrasive in an abrasive dispersion carrier. After the paint sealant is applied to the painted surface, heat is applied by buffing to create temperatures in the range of 270° to 300° Fahrenheit, which in turn burns off the dispersion carriers. When a high gloss on the paint appears, a visual determination can be made to confirm that there is sufficient heat to dissipate the dispersion carriers. Continuing the buffing process after the appearance of the high gloss allows for the abrasions to create the necessary heat to burn off the dispersion carriers, while at the same time polymerizing the T.F.E. monomer gas into a "Teflon" polytetrafluoroethylene polymer or resin. The pure Teflon is deposited in the valleys and over the hills of the paint surface to seal the entire surface of the paint from corrosive elements. A second hard layer of a protective coating, comprising a conventional wax, plastic or silicone, must be applied over the soft, moldable Teflon.

As another aspect of the present invention, it has been found that the Teflon coating and a silicone polymer coating can be applied simultaneously without interference with each other. Moreover, by simultaneously applying the two coatings, the silicone polymers give the added advantage of providing added lubrication to prevent overheating when the buffing machine is used, and therefore, decreasing the chances of damage to the paint.

DESCRIPTION OF THE PREFERRED EMBODIMENT

There is disclosed a paint sealant and method of applying the same to painted surfaces, such as, for example, surfaces of automobiles, recreation vehicles, airplanes, vans, boats, motorcycles, antique cars and even household appliances. The paint sealant is particularly useful on painted metal surfaces where the surfaces comprises a field of minute peaks and valleys. Moreover, the paint sealant is particularly durable in extreme environments, such as where the paint sealant must form a barrier against penetrating harmful ultraviolet and infrared rays of the sun, photolysis, as well as moisture-laden salt air, insects and other corrosive paint destroying elements.

The present invention is directed toward applying a tetrafluoroethylene (T.F.E.) monomer gas, in a monomer dispersion carrier, to the painted surface. The monomer dispersion carrier must be of a specific type that is water soluble, evaporates rapidly at approximately 270° to 300° Fahrenheit, and is capable of dispersing the tetrafluoroethylene monomer into a colloidal suspension. Such a dispersion carrier is isooztylethylene oxide. Preferably, the monomer dispersion by weight comprises approximately 60 percent T.F.E. monomer and approximately 40 percent monomer dispersion carrier. A T.F.E. monomer gas with an appropriate carrier is sold by E. I. DuPont DeMours and Company, Inc. under the trademark Teflon 30.

It is critical to the present invention that the above-described monomer dispersion be mixed with a fine abrasive, such as fuller's earth and carborundum or silica or jeweler's rouge (ferric oxide) or some other combination thereof. The fine abrasive is mixed with any vegetable oil and water dispersion carrier. It is a general practice to create an abrasive dispersion having the abrasive comprise 50 percent by weight of the abrasive dispersion and the vegetable oil and water dispersion carrier comprise 50 percent by weight of the abrasive dispersion. However, it has been found that the abrasive can be varied in quantity from 40 percent to 60 percent by weight of the abrasive dispersion.

The monomer dispersion and the abrasive dispersion are combined. It has been found very desirable to combine the two so that the monomer dispersion comprises approximately 17 percent of the combined chemical composition and the abrasive dispersion comprises approximately 83 percent of the combined chemical composition. At this point, a Teflon paint and sealant composition has been created having the following chemical elements and proportions by weight: the T.F.E. monomer comprising approximately 10 percent, the monomer dispersion carrier comprising approximately 7 percent, the fine abrasive and the abrasive dispersion carrier each comprising approximately 41 percent. As previously described, the amount of abrasive and abrasive dispersion carrier can vary substantially with respect to each other, so that the abrasive can comprise 33 percent to 50 percent by weight with the corresponding inverse change in the abrasive dispersion carrier from 50 percent to 33 percent, so that the combination of the two approximately comprises 83 percent of the overall Teflon paint sealant composition. For quantities suitable for application to one automobile, it has been found that a single bottle containing one-sixth ounce of Teflon dispersion to one ounce of abrasive dispersion to be adequate. Optionally, well known petroleum cleaning solvents may be included in the Teflon paint sealant composition. All of these chemicals are compatible and remain in a chemically stable condition.

As previously described, a number of fluorocarbons were applied, by themselves, to a given painted surfaces. It was found that the powder Teflons would not work. As is well known, tetrafluoroethylene ($F_2C{:}CF_2$) is a flammable, colorless heavy gas, which is insoluable in water, but soluable in a vegetable oil and water dispersion carrier. The T.F.E. gas is a monomer, which when polymerized, forms a "Teflon" polytetrafluoroethylene polymer or resin. It was found that when heat was applied to the Teflon paint sealant composition, to create a temperature from 270° to 300° Fahrenheit, all of the dispersion carriers are burned off without burning or discoloring the paint. At approximately 320° Fahrenheit or more, most paints begin to shrink and be destroyed. To generate enough heat to raise the temperature to the range of 270° to 300° Fahrenheit, it is necessary to have the above described fine abrasive. Hence, the frictional heat created by the abrasive, when using a buffing machine, serves this purpose. As a result, the dispersion carriers are burned off without a grease film forming.

When a high gloss of the paint appears, there is sufficient heat to dissipate the dispersion carriers for the T.F.E. monomer and abrasive. Continuing the buffing process after the high gloss is obtained, allows for the fine abrasive to create enough heat to burn off the dispersion carriers. At the same time, the T.F.E. monomer is polymerized to become sufficiently "moldable" to be forced down into the valleys of the paint. Hence, the moldable, polymerized T.F.E. Teflon deposits over the paint so as to protect the same from corrosive elements, while allowing the paint to remain flexible.

This same technique, as described above, can be used in many other instances; however, use of other Teflons tested created additional problems of burning off the dispersant agents in the automotive and painted surfaces field. The techniques would remain the same in semi-durable and temporary polishes. In this case, higher or lower speeds of buffing machines, with varying pile lengths on the buffing pads, would have to be adjusted to suit the application.

Preheating of the various fluorocarbon compounds creates more problems of uneven coating. Preheating of the surface to be treated again creates the same results, of uneven, blotched and patched coatings.

The exposed Teflon remains relatively soft. Hence, a second hard coating, in the form of a conventional polish, needs to be applied over the Teflon layer. This second protective layer can be a paste Canarba and vegetable wax, paste petroleum based wax, liquid combined vegetable and petroleum wax (acrylic resins) or an activated silicone polyethylene polymer. This second layer can be applied after the T.F.E. Teflon has been applied. It is the application of the T.F.E. Teflon, in the manner described, wherein the present invention primarily resides.

As a second aspect to the present invention, it has been found that a silicone polymer coating can be applied simultaneously with the T.F.E. Teflon coating. This is accomplished by preparing a bottle of Teflon paint sealant composition in a manner previously described. A second chemical composition, contained in a second container or bottle, is prepared and comprises an activated silicone polymer in a dispersion carrier. An emulsifying agent is added to separate and disperse the silicone polymer in the dispersion carrier. Optionally, surfactants, corrosion inhibitors and bonding agents can be mixed with the dispersed silicone polymer. Any type of conventional silicone used for polish formulators can be used in the silicone chemical composition. For example, Dow Corning Corporation of Midland, Michigan provides several such silicones, such as polydimethylsiloxane, aminofunctional polysiloxane. The use of silicone fluids in polish formulations is well known in the art. Moreover, there is available commercially many products which include silicones and also have various combinations of optional chemicals. Any one of these products are suitable. The amount of the silicone chemical composition required is not critical and can vary substantially. In practice, a bottle containing preferably about three ounces of the silicone chemical composition is prepared to be mixed with the previously described one and one-sixth ounces of Teflon paint and sealant composition.

When a final paint sealant is needed for application to the painted surface, the two chemical compositions, the Teflon and the silicone, of the two bottles are mixed together. This mixture will remain in a stable condition for approximately 24 hours. This allows ample time for the combined product to be applied to the painted surface of a standard size automobile in approximately one hour.

The use of silicone polymers has a twofold purpose: first, the silicones give enough lubricity to prevent an overheating condition when a buffing machine is being used, especially at the edges and sharp curves of painted surfaces, such as on fenders, hoods, and trunks of automobiles. Secondly, the activated silicone polymers form a seal over the layer of Teflon that now fills the valleys of the paint.

The process of depositing the pure Teflon in the paint and burning off the dispersants, by applying the two chemical compositions, is accomplished by the following procedure. As is normally undertaken with prior art procedures, an acid type cleaner is used to deep clean the pores of the paint and is then rinsed off and the surface dried with a clean towel of chamois. Next, the final product is applied in one circle onto the wool pile buffing pad, and buffing a 3 foot by 3 foot area is commenced. The area is worked until all the final, combined product has been buffed out and the surface has a high gloss.

When a high gloss of the paint appears, the heat to dissipate the dispersion carriers is obtained. Continuing the buffing process after the high gloss is obtained allows the abrasive compound to create the necessary heat to burn off the dispersion carriers and to deposit the pure T.F.E. Teflon into the valleys of the paint to seal the entire surface of the paint from almost all elements. At this same instant, the silicones cross link themselves to the entire surface so as to become physically bonded to the paint. More specifically, the silicones "plate" themselves on the surface in a continuous film. This takes place with little interference from other ingredients in the polish. The added buffing creates enough heat to burn off all of the optional cleaning fluids, the optional surfactants, the emulsifiers, etc. This leaves a continuity of surface plating of first, the pure Teflon, which is burned into the hills and valleys of the paint to create an impregnable barrier against paint destroying elements, and second, a bonded plating of pure silicone over the Teflon, which gives a durable protective coating that is totally unparalleled in this field today.

Tests have shown that when Teflon was used with silicones, emulsifiers, abrasives, solvents, surfactants, polydimethylsiloxanes and water; buffed into the painted surfaces with the buffing machine turning at 1500 to 1800 R.P.M. and using a wool pile pad with fibers of approximately one to one and one-half inches in length; and the buffing is continued after a high gloss is obtained; the resultant paint sealant is very durable. The durability of the polished surface has been tested by long exposure to 90° Fahrenheit and greater heat and sunlight for long periods, subjected to the equivalent of 100 car washes, and exposed to salt and moisture laden air for two years, without any apparent discoloration, loss of gloss or paint deterioration. The use of a solvent type cleaner is used to remove a build up of detergent, road film and fall-out as needed. With a sufficiently skilled operator, speeds up to 3000 R.P.M. can be used for buffing.

Although particular embodiments of the invention have been shown and described here, there is no intention to thereby limit the invention to the details of such embodiments. On the contrary, the intention is to cover all modifications, alternatives, embodiments, usages and equivalents of the subject invention as fall within the spirit and scope of the invention, specification and appended claims.

What is claimed is:

1. A process for protecting a painted surface, which comprises:

providing a paint sealant composition in the form of a tetrafluoroethylene monomer, a tetrafluoroethylene dispersion carrier, an abrasive compound and an abrasive dispersion carrier;

buffing the paint sealant composition on the painted surface until sufficient heat is created to dissipate the dispersion carriers and to polymerize the tetrafluoroethylene monomer, so as to create a layer of a polymer over the painted surface.

2. In the process of claim 1, coating the polymer layer with a hard protective coating from a group of polishes consisting of waxes, silicones, acrylic resins and plastics.

3. In the process of claim 2, the step of buffing the paint sealant compositions including buffing until a high gloss appears on the paint, continuing to buff the paint sealant compositions after the high gloss appears so as to allow the abrasive compound to generate sufficient heat.

4. In the process of claim 3, buffing the paint sealant composition with a wool pile pad rotating at a rate of 1500 to 3000 rotations per minute.

5. In the process of claim 2, providing a silicone polymer and a dispersion carrier therefor in the paint sealant composition, buffing the silicone polymer dispersion simultaneously with the tetrafluoroethylene monomer and abrasive dispersions to create a coating of silicone over the polymer coating.

6. In the process of claim 2, buffing the paint sealant composition to temperatures ranging from 270 degrees to 300 degrees Fahrenheit.

* * * * *